US006385938B1

(12) United States Patent
Gavin

(10) Patent No.: US 6,385,938 B1
(45) Date of Patent: May 14, 2002

(54) SPACE FOR CONCRETE REINFORCEMENT RODS

(76) Inventor: Norman W. Gavin, 2545 Ridge Rd., North Haven, CT (US) 06473

( * ) Notice: Subject to any disclaimer, the term of this patent is extended or adjusted under 35 U.S.C. 154(b) by 0 days.

(21) Appl. No.: 09/669,599

(22) Filed: Sep. 26, 2000

Related U.S. Application Data

(60) Provisional application No. 60/160,264, filed on Oct. 19, 1999.

(51) Int. Cl.[7] ..... E04C 5/16
(52) U.S. Cl. ..... 52/677; 52/678; 52/689
(58) Field of Search ..... 52/677, 689

(56) References Cited

U.S. PATENT DOCUMENTS 3,280,529 A * 10/1966 Reuss ..... 52/689
3,292,335 A * 12/1966 Stober ..... 52/677
3,348,347 A 10/1967 Berry
D223,701 S 5/1972 Lausch
3,694,989 A * 10/1972 Oliver et al. ..... 52/678
D272,125 S 1/1984 Van Doren
5,347,787 A * 9/1994 Gavin ..... 52/677
5,542,785 A 8/1996 Cloud
5,595,039 A * 1/1997 Lowery ..... 52/677

* cited by examiner

*Primary Examiner*—Carl D. Friedman
*Assistant Examiner*—Steve Varner
(74) *Attorney, Agent, or Firm*—Robert A. Seemann

(57) ABSTRACT

A pair of curved arms attached to a body form an annular seat for holding a first diameter rebar, a slot through the outer diameter of the body forms a radially inward pathway to the seat for rebar, the apex of a convex bar attached to the body is yieldable radially outward to pressure of a second, larger diameter rebar in the seat and is not significantly moved by the first diameter rebar when the smaller diameter first diameter rebar is in the seat. The seat springally grips either diameter rebar.

7 Claims, 3 Drawing Sheets

SPACE FOR CONCRETE REINFORCEMENT RODS

This application claims the benefit of U. S. Provisional Application No. 60/160,264, filed Oct. 19, 1999.

BACKGROUND OF THE INVENTION

1. Field of the Invention

This invention relates to spacers or wheel chairs that are mounted on concrete reinforcement rods or rebar to keep the rebar from lying against the inner side of a concrete pouring form or mold where the rebar would be at the surface of the hardened concrete where it would be unsightly, exposed to weather, and be of reduced effectiveness in reinforcing the body of the concrete. Rebar comes in several diameters.

2. Description of the Prior Art

The art is replete with patented designs for rebar spacers. They include wheel-halves that clamp around the rebar, and wheels that hinge open and ratchet closed on the rebar.

U.S. Pat. No. Des. 223,701 patented May 30, 1972 by J. Lausch describes a spacer wheel support for rebar. The wheel has a polysided circumference. A cylindrical opening through the center of the wheel is attached by a radial rod to each vertex of the joining of the circumferential sides. A radial opening through a side of the cylinder to and through the circumference of the wheel is provided between two of the radial rods that are joined continuously by the circumference of the cylinder.

U.S. Pat. No. Des. 272,125 patented Jan. 10, 1984 by V. Doren describes a nailing block spacer that has a solid base having lateral axial nailing grooves and an axial tube atop the base that has flexible walls and a slot providing radial access to the tube by rebar. The base extends into the tube opposite the slot in a raised axial solid ridge.

U.S. Pat. No. 3,280,529 patented Oct. 25, 1966 by K. Reuss describes a spacer wheel having a circumferential wall and a cylindrical axial opening. A radial opening through a side of the cylinder to and through the circumference of the wheel is provided between two radial rods that are joined continuously by the circumference of the cylinder. About 90 degrees around from the radial opening, left and right rods extend radially from the cylinder wall to the circumference. Each rod has an angular dip at a point in its length to take up compression or tensile stress in the rod so that the open side of the cylinder can be forced apart to receive rebar. A short rod extends from the cylinder wall, radially outward opposite from the radial opening. The distal end of the short rod is spaced a sufficient distance from the circumferential wall such that the short rod prevents the cylinder from bending excessively at the base of the radial opening under the influence of large external downward or twisting load or stress transmitted to the spacer by the rebar.

SUMMARY OF THE INVENTION

It is one object of the invention to provide a spacer that can be attached to a rebar with gloved hands.

It is another object of the invention that the spacer be generally uniform in extension of its outermost surface from the rebar so that each spacer of a plurality of spacers mounted along the length of a bar will provide the same spacing from the form wall at each mounting location as the other spacers.

It is another object that a single spacer can be mounted on either of at least two different diameter bars.

It is another object that the spacer is molded in one piece.

An outer ring for contacting an object has an opening through it. A first resilient arm that is attached to the outer ring adjacent to the opening on a first side of the opening extends inward from the outer ring and terminates in a free end. A second arm that is attached to the outer ring adjacent to the opening on a second side of the opening extends inward from the outer ring, terminates in a second free end, and forms a slot with the first arm for moving rebar through the opening to the first and second free ends. The first and second arms form a first stop and a second stop spaced from the first stop for holding rebar that is moved into the opening and slot, between the first and second arms and the first and second stop. An inner ring that comprises the slot is attached to the first arm, the second arm, is spaced from the outer ring and from the first and second stops.

A spacer for rebar includes a body having an outer surface, a pair of arms attached to the body having free ends forming a seat for holding a first diameter rebar, a slot through the outer surface in communication with the pair of arms forming a pathway for moving a first diameter rebar radially inward of the outer surface into the seat, a bar attached to the body so that a portion of the bar extends toward the seat, the portion being yieldable radially outward from the seat to pressure of a second larger diameter rebar when the second rebar is in the seat. Preferably the portion is mounted on the body so that the portion is not significantly moved by the first diameter rebar when the first diameter rebar is in the seat. Preferably the spacer is a molded in one piece item.

Other objects and advantages of the invention will become apparent to persons skilled in the art from the ensuing description.

BRIEF DESCRIPTION OF THE DRAWINGS

In order that the invention will be more fully comprehended, it will now be described, by way of example, with reference to the accompanying drawings in which.

DESCRIPTION OF THE PREFERRED EMBODIMENTS

Figure 1:
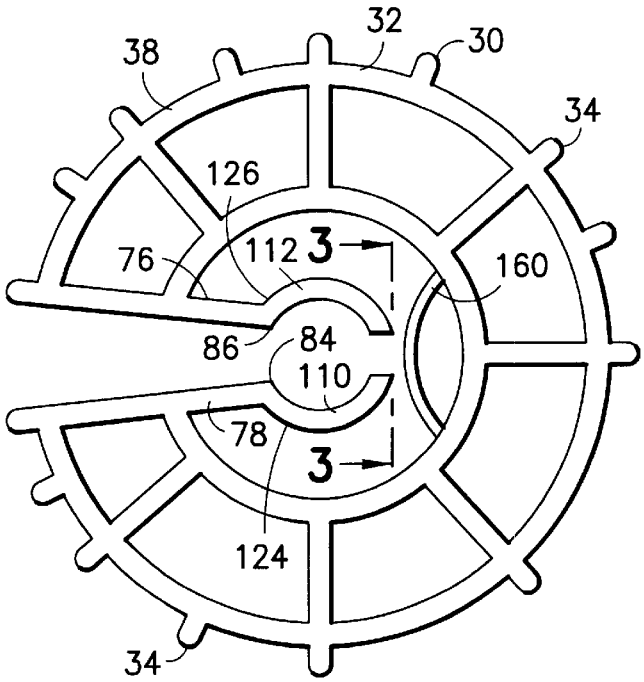
FIG. 1 is a front view of a spacer of the invention.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

In the following description, the word "chair" includes the meanings "spacer for rebar and rods", and "wheel chair for rebar and rods". The term "rebar" includes the meanings "rebar" and "rods".

Figure 2:
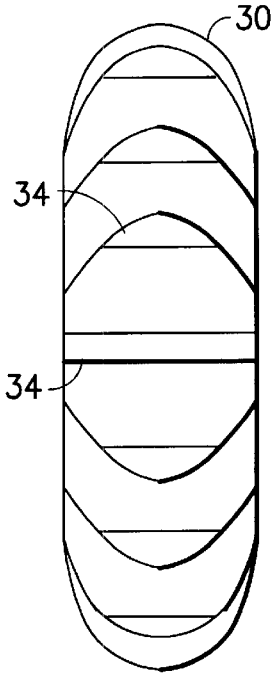
FIG. 2 is a side view of the spacer of FIG. 1
Figure 3:
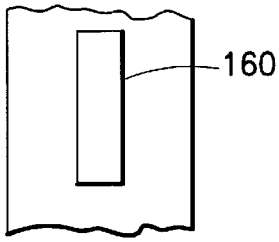
FIG. 3 is a view of a portion of the spacer of FIG. 1 taken along 3—3.

In FIGS. 1, 2, and 3, chair 30 is in a relaxed state because there is no rebar in the chair. The chair is preferably made of plastic, and is molded in one piece.

Bumps 34 are designed to hold outer rim 38 away from the concrete form wall when the chair is resting against the wall.

Figure 4:
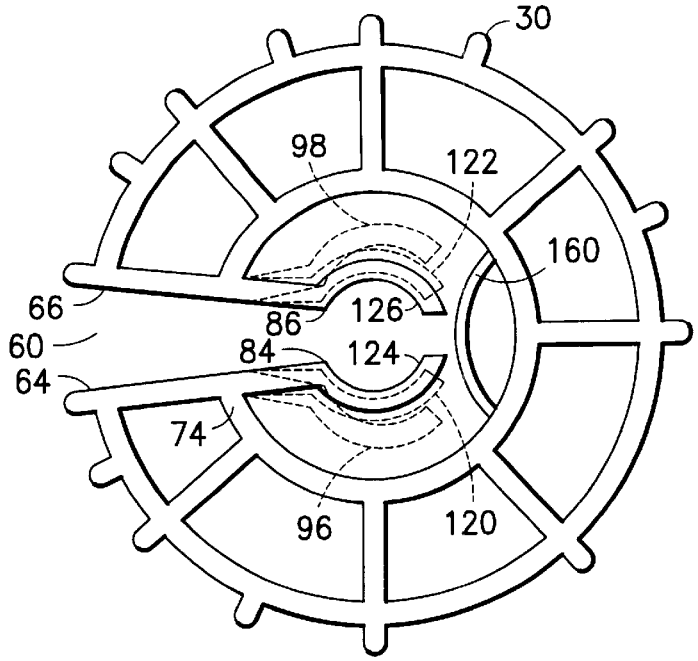
FIG. 4 is a front schematic view of the spacer of FIG. 1 comparing the spacer profile empty and with a first size rebar. The rebar is not shown.
Figure 5:
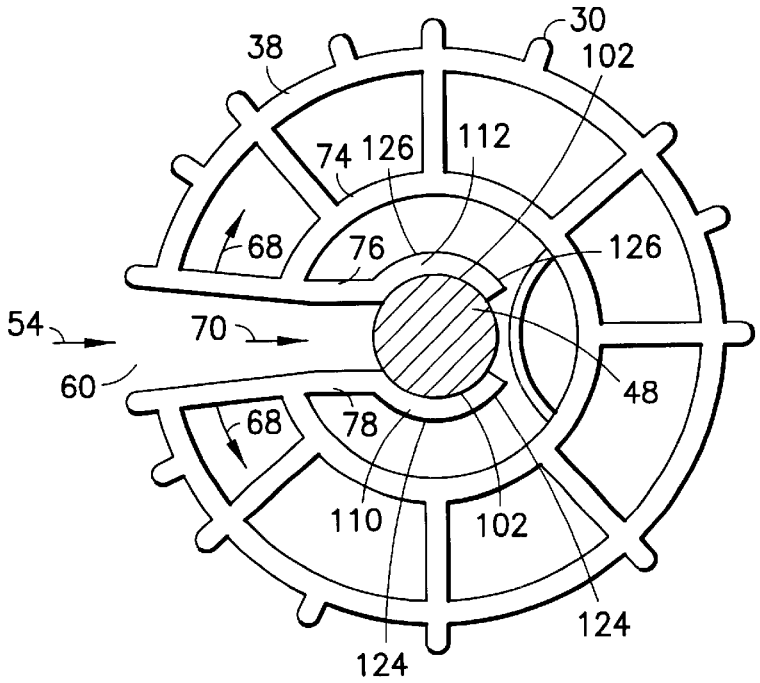
FIG. 5 is a front schematic view of the spacer of FIG. 4 with the first size rebar shown.

In FIGS. 4 and 5, chair 30 holds rebar 48 which is shown in cross section in FIG. 5. Rebar 48 is not shown in FIG. 4 for clarity of viewing.

Rebar 48 is installed in the chair by forcing the rebar into 54 slot 60. Radial bars 64, 66 are forced apart 68 slightly by the rebar as it moves past ring 74. When rebar 48 moves radially inward 70 beyond ring 74, it forces arms 76, 78 to bend apart and edges 84, 86 to move apart as shown by dotted lines 96, 98. When the rebar moves radially inward past edges 84, 86, it moves into encirclement 102 by curved arms 110, 112 which fall back against the rebar under elastic force of arms 76, 78 and some small additional elastic force of the body of the chair. This new position at which curved arms 110, 112 grip the rebar is shown by dotted lines 120, 122. Solid lines 124, 126 of the arms in FIGS. 1 and 4 show curved arms 110, 112 when they are at rest, while the solid lines 124, 126 of the curved arms in FIG. 5 show the curved arms at the position of dotted lines 120, 122 of FIG. 4.

Figure 6:
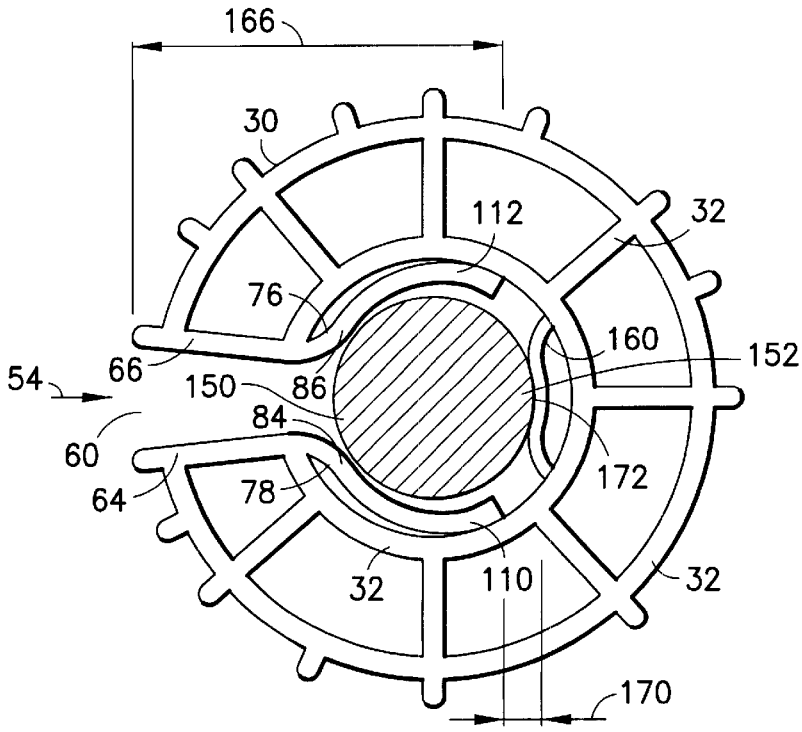
FIG. 6 is a front schematic view of the spacer of FIG. 1 holding a second size rebar that has a larger diameter than the first size rebar.

In FIG. 6, rebar 150 is held by chair 30. Rebar 150 is a larger diameter than rebar 48. When rebar 150 is forced into 54 slot 60; front portion 166 of body 32 of chair 30, bars 64, 66, edges 84, 86, and arms 76, 78 are forced apart further than they are forced apart with rebar 48. Curved arms 110, 112 are forced against ring 74, and rebar 150 forces bar 160's convex curve down in compression of bar 160. Rebar 150 is held very strongly by the inward springy forces of arms 76, 78 and of front portion 166 of body 32 of chair 30 expressed upon arms 76, 78 and upon curved arms 110, 112 which springy forces are delivered against rebar 150 by edges 84, 86, countered on side 152 of the rebar by compressed bar 160. The compression of bar 160 from the convex form to a flattened form, or to a concave form, provides a large range of radial movement 170 of point of contact 172 on bar 160, greater range, and greater accommodation without chance of breaking bar 160 than if bar 160 were a straight bar or a concave bar at the outset.

Figure 7:
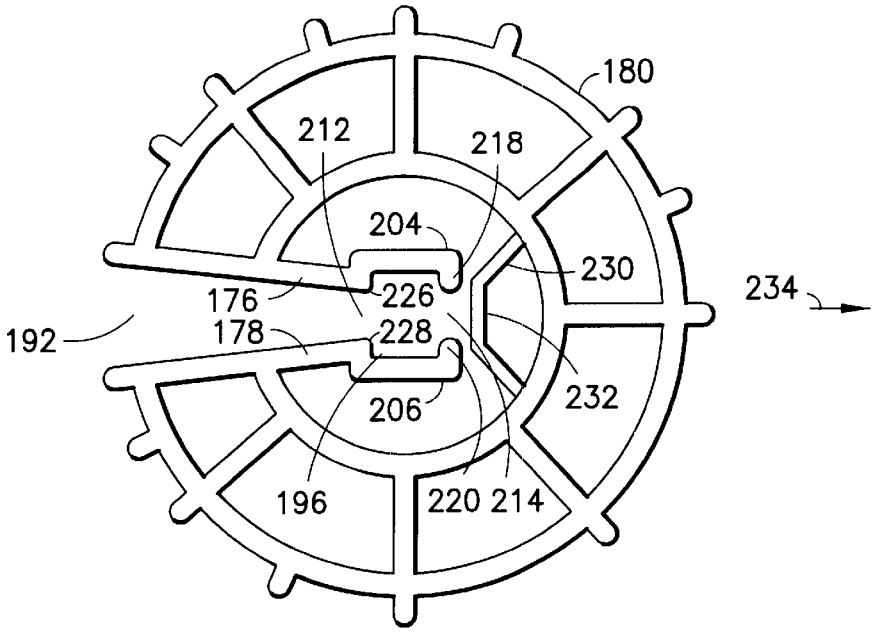
FIG. 7 is a front view of another spacer of the invention.

In FIG. 7, arms 176, 178 of wheel chair 180 are at neutral elastic position. This is the position that free ends 204, 206 resile toward when they are forced apart by rebar that is forced along slot 192 into seat 196 that is bounded by free ends 204, 206 and stops 212, 214. Stop 214 is provided by inward extending ends 218, 220. Stop 214 is provided by inward extending portions 226, 228 of arms 176, 178. Portion 232 of bar 230 extends toward seat 196. Portion 232 yields radially outward 234 from seat 196 to pressure of rebar that is in seat 196 when the diameter of the rebar is sufficiently large enough to displace portion 232.

While the preferred embodiment of the invention has been shown and described, it will be understood that the invention may be embodied otherwise than as herein specifically illustrated or described, and that certain changes in form and arrangement of parts and in the specific manner of practicing the invention may be made without departing from the underlying idea or principles of this invention within the scope of the appended claims.

What is claimed is:

1. A spacer for mounting on a reinforcement rod used in concrete item manufacture for spacing said rod from an object, said spacer comprising:

an outer ring for contacting an object, an opening through said outer ring, a first resilient arm attached to said outer ring adjacent to said opening on a first side of said opening, extending inward from said outer ring, terminating in a first free end, a second arm attached to said outer ring adjacent to said opening on a second side of said opening, extending inward from said outer ring, terminating in a second free end, forming a slot with said first arm for moving reinforcement rod through said opening to the first and second free ends, said first and second arms forming a first stop and a second stop spaced from said first stop for holding reinforcement rod that is moved into the opening and slot, between the first and second arms and the first and second stop, a first bar spanning the first and second free ends, mounted on said outer ring so that said first bar is movable away from the first and second free ends.

2. The spacer of claim 1 further comprising:

an inner ring comprising said slot, attached to said first arm, said second arm, said first bar, spaced from said outer ring and from the first and second stops.

3. The spacer of claim 1 wherein said spacer is a molded in one piece item.

4. A spacer for mounting on a reinforcement rod used in concrete item manufacture for spacing said rod from an object, said spacer comprising:

a first ring, an opening through said first ring, a first resilient arm attached to said first ring adjacent to said opening on a first side of said opening, extending inward from said first ring, terminating in a first free end, a second arm attached to said first ring adjacent to said opening on a second side of said opening, extending inward from said first ring, terminating in a second free end, forming a slot with said first arm for moving reinforcement rod through said opening to the first and second free ends, said first and second arms forming a first stop and a second stop spaced from said first stop for holding reinforcement rod that is moved into the opening and slot, between the first and second arms and the first and second stop, a first bar spanning the first and second free ends, mounted on said first ring, a portion of said first bar being spaced from said first ring so that said first bar is movable away from the first and second free ends.

5. A spacer for rebar comprising:

a body having an outer surface, a pair of arms attached to said body, having free ends forming a seat for holding a first diameter rebar, a slot through said outer surface in communication with said pair of arms forming a pathway for moving a first diameter rebar radially inward of said outer surface into said seat, a bar attached to said body so that a portion of the bar extends toward said seat, said portion being yieldable radially outward from said seat to pressure of a second larger diameter rebar when said second larger rebar is in said seat.

6. The spacer of claim 5, wherein said portion is mounted on said body so that said portion is not significantly moved by said first diameter rebar when said first diameter rebar is in said seat.

7. The spacer bar of claim 5 wherein said spacer bar is a molded in one piece item.

* * * * *

UNITED STATES PATENT AND TRADEMARK OFFICE

CERTIFICATE OF CORRECTION

PATENT NO. : 6,385,938 B1
DATED : May 14, 2002
INVENTOR(S) : Norman W. Gavin

It is certified that error appears in the above-identified patent and that said Letters Patent is hereby corrected as shown below:

Title page,
Item [54], Title, change the title from "SPACE FOR CONCRETE REINFORCEMENT RODS" to -- SPACER FOR CONCRETE REINFORCEMENT RODS --.

Signed and Sealed this

Twenty-third Day of July, 2002

*Attest:*

*Attesting Officer*

JAMES E. ROGAN
*Director of the United States Patent and Trademark Office*